US006308606B1

(12) United States Patent
Buchholtz et al.

(10) Patent No.: US 6,308,606 B1
(45) Date of Patent: Oct. 30, 2001

(54) SAW CHAIN FOR A MOTOR-DRIVEN CHAIN SAW

(75) Inventors: Jochen Buchholtz, Waiblingen; Bernd Andress, Erdmannhausen, both of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/404,165

(22) Filed: Sep. 27, 1999

(30) Foreign Application Priority Data

Sep. 26, 1998 (DE) ..... 198 44 245

(51) Int. Cl.[7] ..... B27B 33/14
(52) U.S. Cl. ..... 83/834; 83/830
(58) Field of Search ..... 83/833, 834, 830, 83/831, 832; 30/383; 125/21

(56) References Cited

U.S. PATENT DOCUMENTS

| | | | | |
|---|---|---|---|---|
| 2,928,440 | | 3/1960 | Fors . | |
| 3,291,169 | * | 12/1966 | Morner | 30/383 |
| 3,329,183 | * | 7/1967 | Robinson | 83/834 |
| 3,444,907 | * | 5/1969 | Chadwick | 83/831 |
| 4,459,890 | * | 7/1984 | Dolata et al. | 83/834 |
| 4,581,968 | * | 4/1986 | Gibson et al. | 83/834 |
| 4,593,591 | * | 6/1986 | Beerens | 83/834 |
| 5,257,568 | * | 11/1993 | Nitschmann | 83/830 |
| 6,058,825 | * | 5/2000 | Harfst | 83/834 |

* cited by examiner

*Primary Examiner*—Kenneth E. Peterson
*Assistant Examiner*—Stephen Choi
(74) *Attorney, Agent, or Firm*—Walter Ottesen

(57) ABSTRACT

The invention is directed to a saw chain for a motor-driven chain saw comprising center drive links and lateral connecting links which are pivotally connected to each other via rivets lying transversely to the longitudinal direction of the chain. Individual connecting links are configured as cutting links and have a cutting tooth with a roof bent over toward the chain center. The roof has a leading edge and a trailing edge which lie each transverse to the longitudinal direction of the chain. The leading edge is configured as a roof cutting edge and lies higher than the trailing edge which lies at a spacing above a depression. The depression is formed in the region between the rivet holes in the adjacent upper edge of the drive link and delimits a chip channel. The recess is formed asymmetrically on a drive link with respect to the center perpendicular of an imaginary connecting line between the center points of the rivet holes. In this way, a blockage-free removal of chips is ensured and a high cutting power is provided.

16 Claims, 5 Drawing Sheets

SAW CHAIN FOR A MOTOR-DRIVEN CHAIN SAW

BACKGROUND OF THE INVENTION

A saw chain for a motor-driven chain saw is disclosed in U.S. Pat. No. 2,928,440. The cutting links arranged in the saw chain have a roof surface that is bent over the saw chain whereby a chip channel is formed between the center drive link and the roof surface of the lateral adjacent cutting tooth. The edge of the drive link faces toward the roof surface and defines a uniform recess. The deepest location of this recess lies in the center between the rivet holes of the drive link as seen in side elevation.

Problems can occur with respect to the removal of chips in dependence upon the material to be cut. The chip channel can become clogged whereby the cutting power is affected.

SUMMARY OF THE INVENTION

It is an object of the invention to improve a saw chain of the kind referred to above so that a high cutting power is achieved with a simple configuration and a low forward thrust force.

The saw chain of the invention is for a motor-driven chain saw. The saw chain defines a longitudinal axis and includes: a plurality of center drive links and a plurality of side connecting links, the links being pivotally interconnected by rivets lying transversely to the longitudinal axis; the saw chain defining a center plane passing through the longitudinal axis; a portion of the connecting links being configured as cutting links; each one of the cutting links including a rearward wall portion bent over toward the center plane to define a cutting tooth having a roof; the roof having a leading edge extending transversely to the center plane and defining a cutting edge; the roof also having a trailing edge extending transversely to the center plane and the trailing edge being at a lower elevation than the leading edge; individual ones of the drive links each having a body defining two rivet holes formed therein and each one of the individual ones of the drive links having an upper edge; the upper edge having a region extending between first and second imaginary lines passing through the rivet holes perpendicular to the longitudinal axis; the upper edge having a recess formed therein in the region; the trailing edge of the roof extending over the recess at a distance therefrom and the recess delimiting a chip channel for guiding chips cut by the cutting edge; the rivet holes having center points connected by an imaginary line; and, the recess, when viewed in side elevation, being configured in the region of the upper edge to be asymmetrical relative to an imaginary center perpendicular bisecting the imaginary line into two equal segments.

It has been surprisingly shown that already an asymmetric configuration of the recess leads to a significant increase in cutting power for a constant forward thrust force with the assembly otherwise being unchanged. In practice, an improvement of the cutting power of over 15% with a high mechanical strength of the chain has been determined for a configuration of an asymmetrical recess on the center drive link. Even the configuration of an asymmetrical edge of an outside connecting link leads to an improved cutting power. This configuration on the external cutting link can, for example, be an asymmetrical recess.

In this connection, it has been shown to be advantageous to make up the recess from at least two differently steep edge sections. The transition from the leading edge section to the trailing edge section can be rounded as well as be configured at an angle. The edge sections delimit an angle preferably greater than 90°.

Advantageously, the leading edge section defines an inclined plane which runs approximately parallel to the roof surface of the cutting tooth. When the inclined plane drops off at a somewhat larger angle in a direction opposite to the running direction of the saw chain than the magnitude of the free angle of the roof surface, then the chip channel expands in opposition to the running direction of the chain thereby countering clogging. The chip channel is formed between the edge of the drive link and the roof surface. The trailing edge section increases steeply in a direction opposite to the running direction of the saw chain and extends from the leading edge section. The trailing edge section imparts to the chip a component of movement inclined toward the outside and away from the saw chain whereby a good removal of the chip is ensured.

In a preferred embodiment, the deepest location of the depression is provided in the running direction of the saw chain behind the trailing edge of the roof area and is advantageously approximately in the region of the trailing rivet hole of the drive link.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
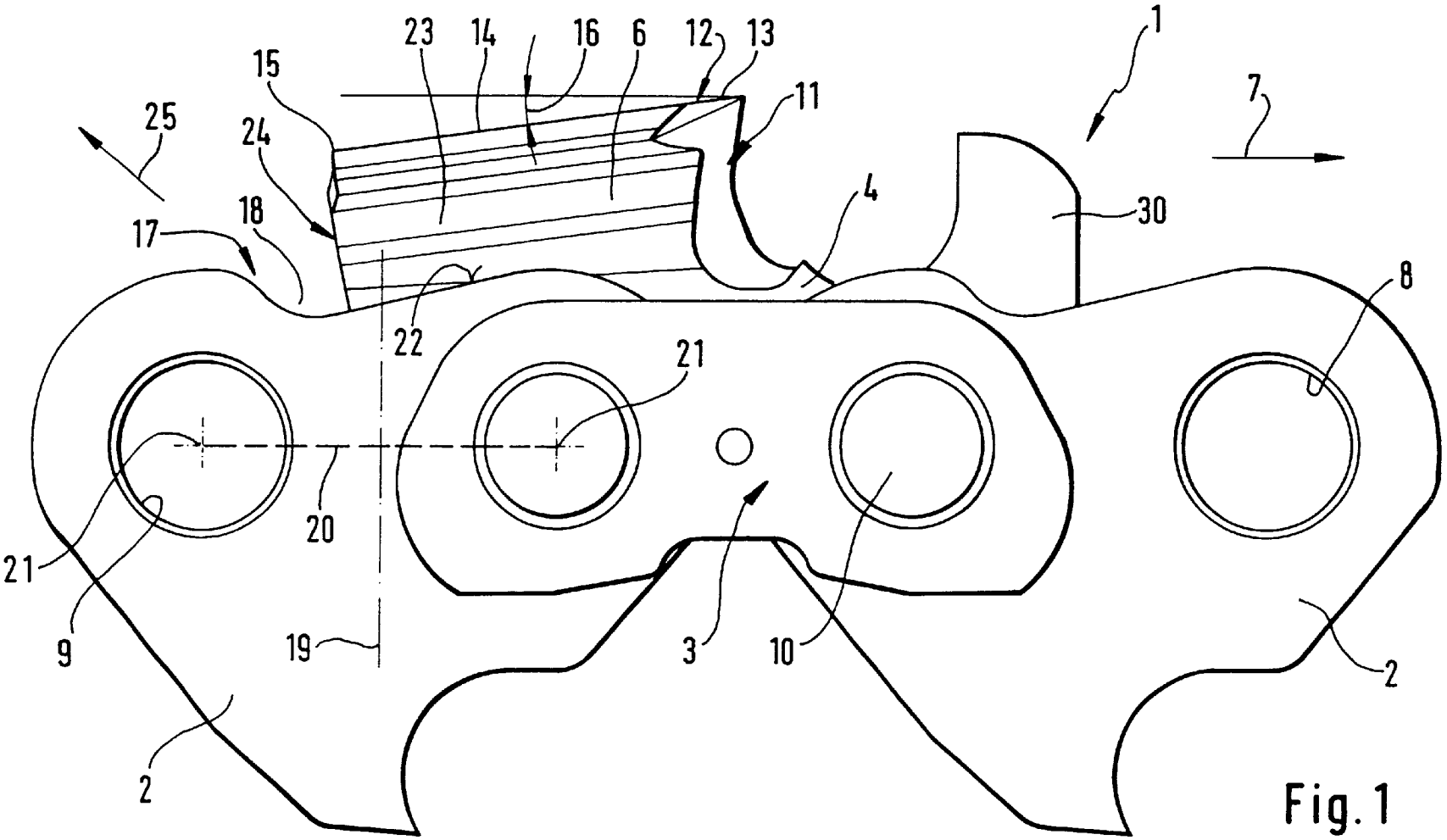
FIG. 1 is a side elevation view of a portion of a saw chain which includes drive links and connecting links.

The segment of a saw chain 1 shown in FIG. 1 comprises two center drive links 2 which are connected to each other by connecting links (3, 4). A plurality of center drive links 2 are connected to each other in a row in the longitudinal direction of the chain by means of the connecting links 3 and 4 whereby a saw chain of interconnecting links is formed. The drive links 2 and the connecting links (3, 4) each have a leading rivet hole 8 and a trailing rivet hole 9 in the running direction 7 of the chain. Rivets 10 lie in the rivet holes (8, 9) which pivotally connect the chain links to each other.

The connecting links 4 are cutting links and are arranged in the longitudinal direction of the chain left and right. The connecting links 4 are configured with cutting teeth 6. Each cutting tooth 6 has a side cutting edge 11, which faces toward the outer side of the chain, as well as a roof cutting edge 12 lying transversely over a next-adjacent drive link 2. The roof cutting edge 12 is configured on the leading edge 13 of a roof 14 bent over approximately at right angles toward the center of the chain. The leading edge 13, which is configured as a roof cutting edge 13, lies higher than the trailing edge 15 of the roof 14. The trailing edge 15 lies transversely to the longitudinal direction of the chain. The roof surface 14 defines a free angle 16 with the horizontal of from 30° to 11°.

A leading depth limiter 30 is arranged so as to lead the cutting tooth 6 and is formed on the same base body of the connecting link 4. The depth limiter 30 extends essentially in the plane of the base body.

Figure 2:
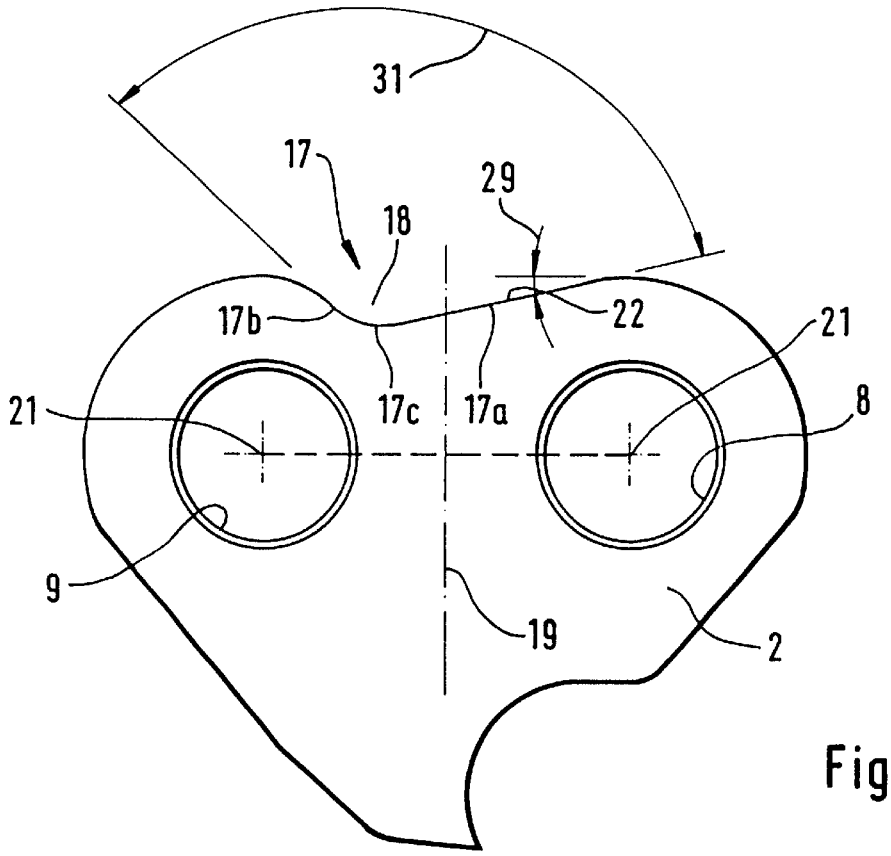
FIG. 2 is a side elevation view of one of the drive links of the saw chain of FIG. 1.

The next-adjacent drive link 2 has an upper edge 17 which faces toward the roof 14. The upper edge 17 has a recess 18 which extends over the entire width of the drive link 2 and is transverse to the longitudinal axis of the chain. As also shown in FIG. 2, the recess or depression 18 of the edge 17 lies unsymmetrical to a center perpendicular 19 of an imaginary connecting line 20 between the center points 21 of the rivet holes 8 and 9. It can be advantageous to not only configure the drive links 2, which lie below a roof 14, but all center drive links 2 with an asymmetrical depression in accordance with the invention. The center drive links 2 lie in a row one behind the other. The drive links 2 of a saw chain are then all like parts.

The depression 18 is made up of two differently steep edge sections 17*a* and 17*b*. In the embodiment of FIGS. 1 and 2, the transition 17*c* from the edge section 17*a* to the trailing edge section 17*b* is rounded. As shown in FIG. 1, the deepest location of the depression 18 (that is, the transition 17*c*) lies behind the trailing edge 15 of the roof 14 as seen in the running direction 7 of the chain. Preferably, the deepest location, that is, the transition 17*c* lies in the region of the trailing rivet hole 9 of the drive link 2.

As shown in FIGS. 1 and 2, the leading edge section 17*a* is configured in the manner of an inclined plane 22 which drops off in opposition to the running direction 7 of the chain from approximately above the leading rivet hole 8 to the deepest location at the transition 17*c* in the region of the trailing rivet hole 9. The inclined plane 22 and the roof 14 conjointly delimit a chip channel 23 through which the cut chip is transported away. For this purpose, the inclined plane 22 can lie approximately parallel to the roof 14. Preferably, the leading edge section 17*a* drops off at an angle 29 in opposition to the running direction 7 of the chain. The angle 29 is slightly greater than the free angle 16 so that the chip channel 23 expands toward its rearward end 24 in a direction opposite to the running direction of the chain. This ensures a blockage-free removal of chips. The trailing rounded edge section 17*b* climbs steeply in a direction opposite to the running direction 7 of the chain and defines a type of ramp. This ramp conveys a chip exiting from the chip channel 23 away from the drive link 2 approximately in the direction of arrow 25. The two edge sections 17*a* and 17*b* conjointly define an angle 31 of greater than 90° which opens toward the roof 14. The angle 31 is preferably 110° to 135°.

Figure 3:
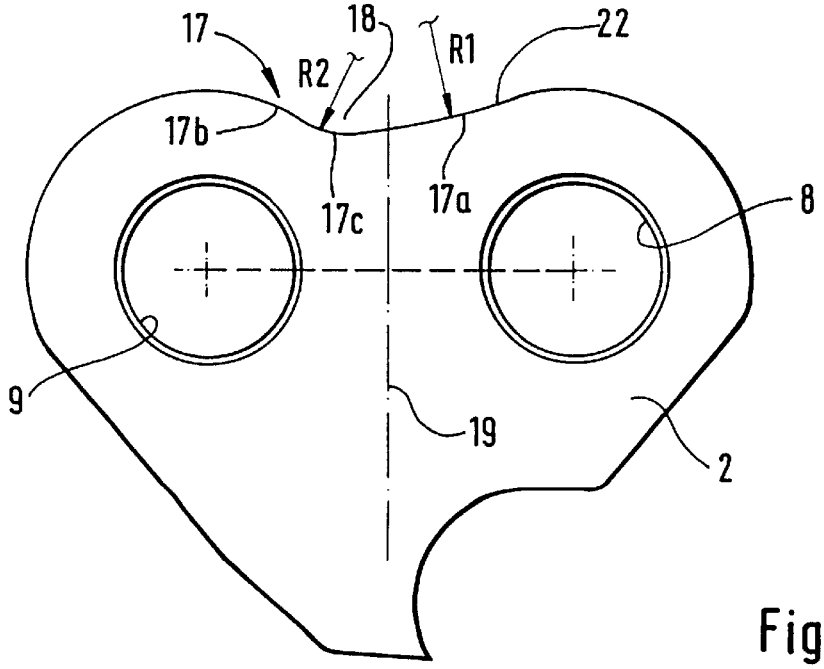
FIG. 3 is a side elevation view of a drive link according to another embodiment of the invention.

As shown in FIG. 3, the inclined plane 22 can also be slightly concave with the radius R1 similar to a trough whereby a chip channel 23 can likewise be achieved. The chip channel 23 expands in cross section toward end 24.

In the embodiment of FIG. 3, the edge sections 17*a* and 17*b* are rounded with very different radii R1 and R2. The curve radius R1 of the leading edge section 17*a* is greater by a multiple than the curve radius R2 of the trailing edge section 17*b* which is rounded and extends from the leading edge section 17*a*. In this way, the trailing edge section 17*b* forms a ramp opposite to the running direction of the chain which leads the chip away from the chain toward the outside. The trailing edge section 17*b* is configured with the smaller curve radius R2. Advantageously, the trailing edge section 17*b* forms an extension of the drive link contour especially in the region of the rivet hole 9.

Figure 4:
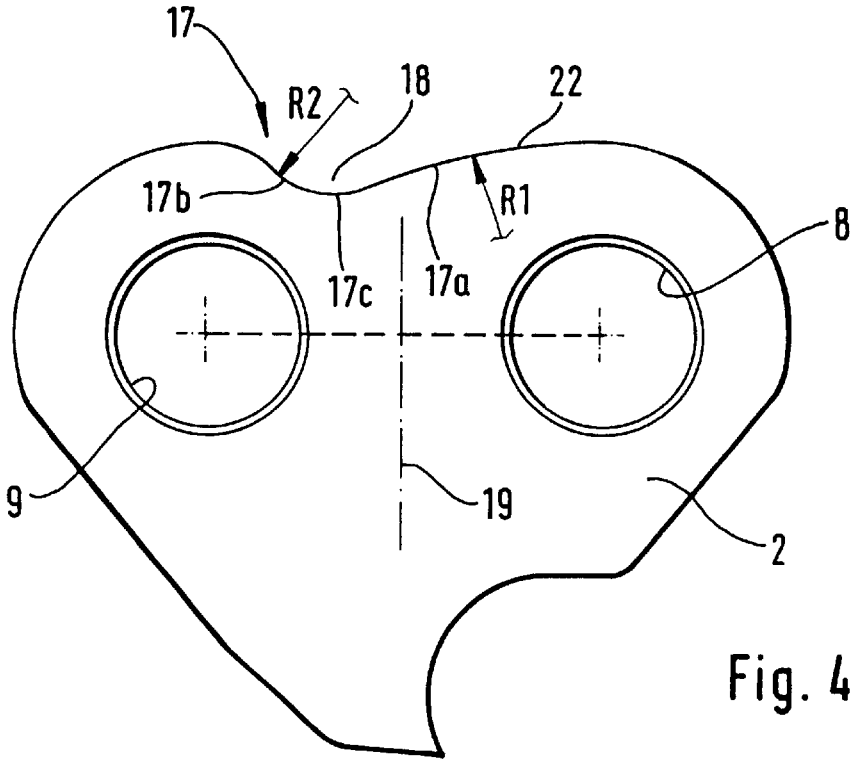
FIG. 4 is a side elevation view of a drive link in accordance with another embodiment of the invention.

In the embodiment of FIG. 4, the leading edge section 17*a* is convexly rounded with a large radius R1 which can ensure a blockage-free removal of chips in dependence upon the material to be cut.

Figure 5:
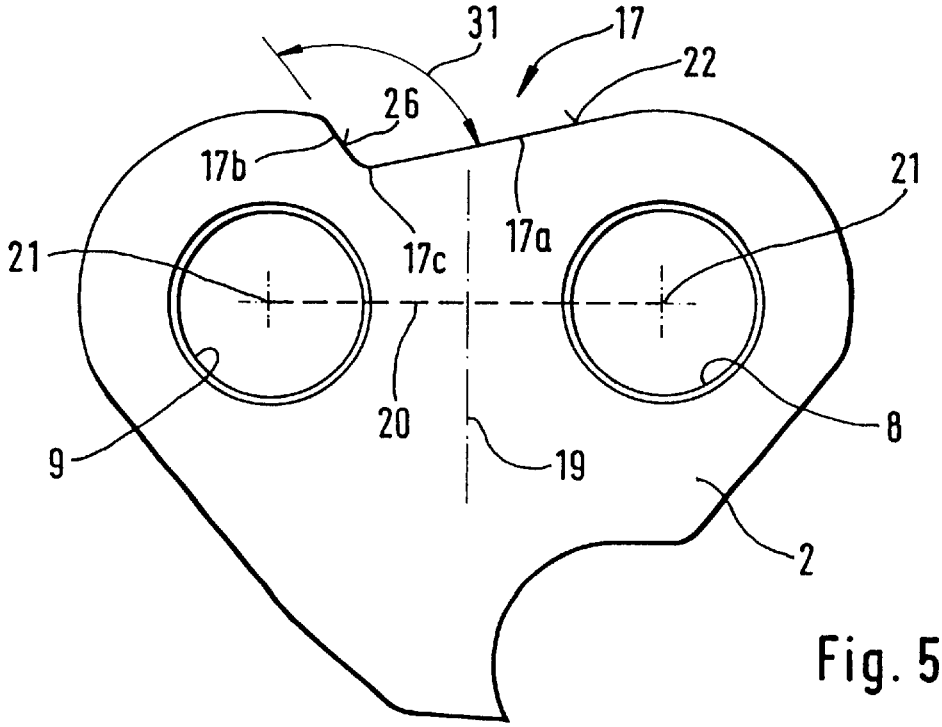
FIG. 5 shows a drive link having inclined planes following at an angle to each other.

In the embodiment of FIG. 5, the leading edge section 17*a* again projects beyond the center perpendicular 19 and increases in elevation in the running direction. The leading edge section 17*a* is configured as an inclined plane 22 and extends at an angle 31 into the edge section 17*b* which is likewise configured as an inclined plane 26. The inclined plane 26 of the edge section 17*b* increases steeply in a direction opposite to the running direction 7 of the chain. The transition 17*c* from the leading edge section 17*a* to the trailing edge 17*b* is configured so as to be angular. The angle 31 is preferably greater than 90°; in the embodiment shown, the angle is approximately 110°.

Figure 6:
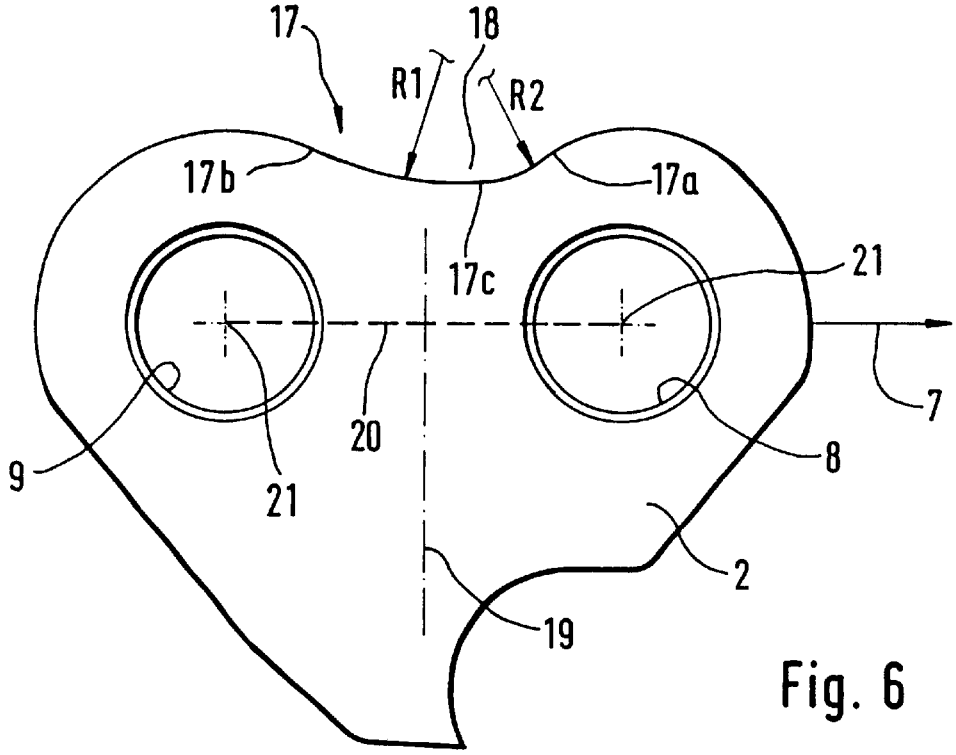
FIG. 6 is a side elevation view of a drive link having a depression or recess made up of edge sections of different radii of curvature.
Figure 7:
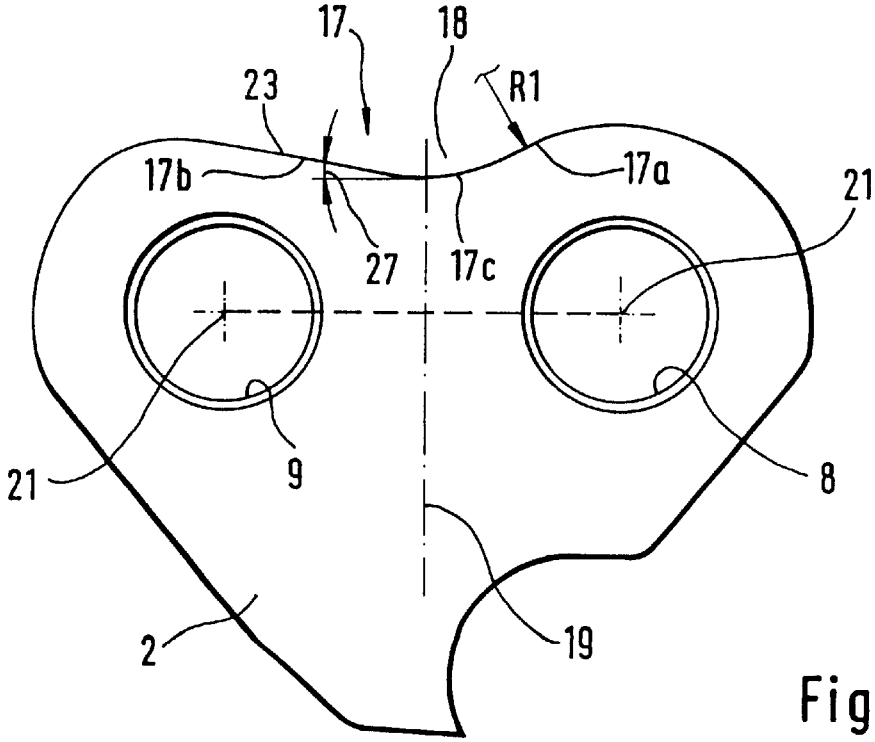
FIG. 7 is a side elevation view of a drive link of FIG. 6 having a depression made up of an inclined plane and an edge section having a radius of curvature; and, FIG. 8 is a side elevation view showing a portion of a saw chain having an overly high side connecting link.

In the embodiments of FIGS. 1 to 5, the depression 18 and the transition 17 from the leading edge section 17*a* to the trailing edge section 17*b* trails the center perpendicular 19 to the imaginary connecting line 20 between the center points 21 of the rivet holes 8 and 9. In contrast, FIGS. 6 and 7 show a configuration wherein the depression 18 (or its lowest location at the transition 17*c* ) between the leading edge section 17*a* and the trailing edge section 17*b* in the running direction 7 lies at the elevation or forward of the center perpendicular 19. In the embodiment of FIG. 6, the edge sections 17*a* and 17*b* are rounded with greatly different radius R1 and R2. The edge section 17*a* has the smaller curve radius R2 and lies forward in the running direction 7 of the chain. The edge sections 17*a* and 17*b* are connected with a curve. The lowest location configured at the transition between the edge sections 17*a* and 17*b* lies in the chip channel 23 formed between the drive link 2 and the roof 14.

In the embodiment of FIG. 7, the leading edge section 17*a* is rounded concavely with a large radius R1 and extends via a rounded transition 17*c* from a trailing inclined plane 23 of lesser slope. The plane 23 defines the edge section 17*b* and has a slope angle 27 of approximately 8° to 10°.

The configuration of the depression 18 is asymmetrical with respect to the center perpendicular 19 of the imaginary connecting line 20 between the center points 21 of the rivet holes 8 and 9. This configuration of the depression 18 also permits a configuration of the chain link in a manner to provide more material at locations which are intensely mechanically loaded than at other locations. The depression 18 is provided for a reliable removal of chips in the drive link and can be placed at a location of the chain link which is subjected to reduced load.

Figure 8:
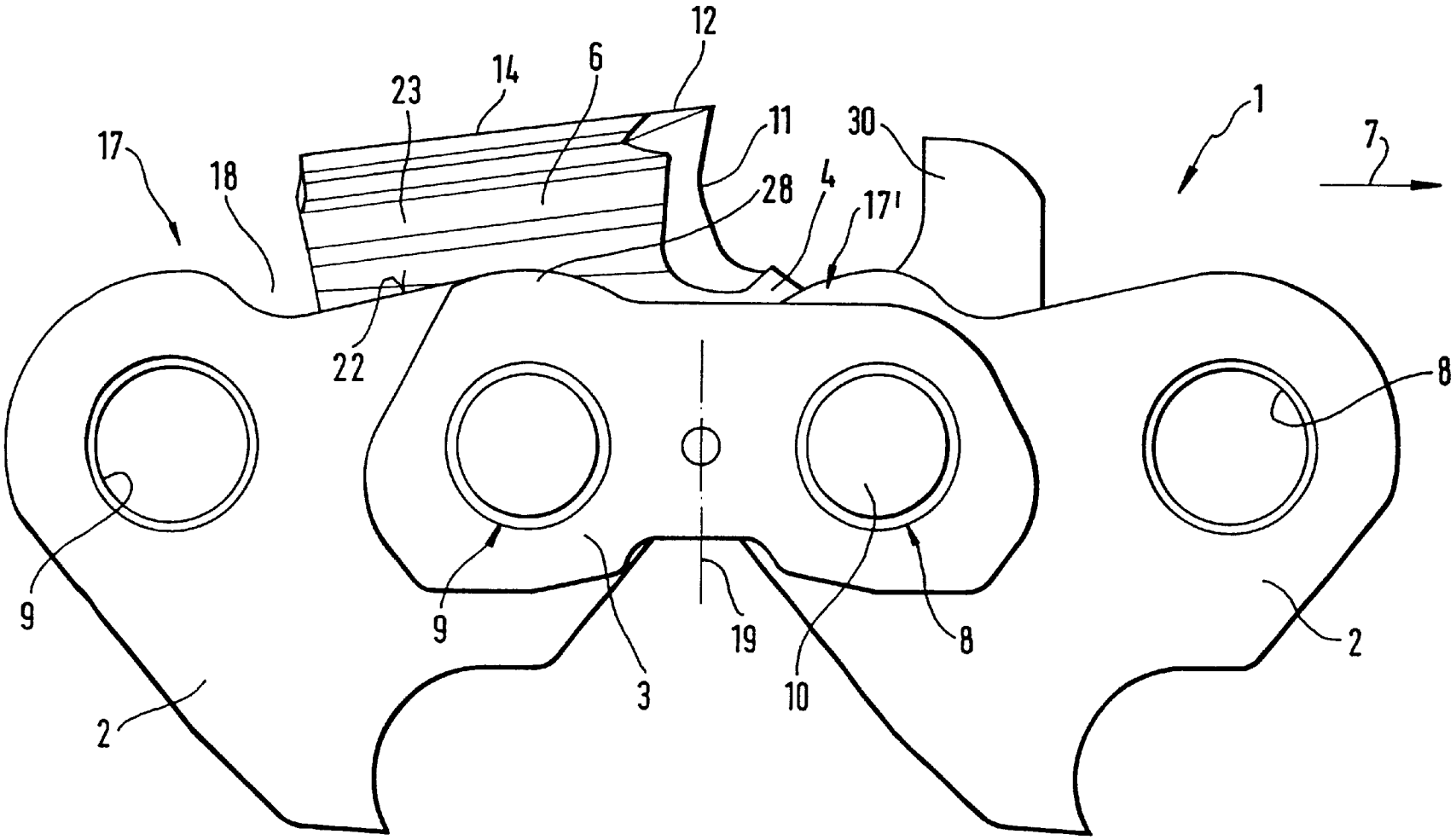

As shown in FIG. 8, it can be advantageous to configure also the simple connecting link 3 at its edge 17' facing toward the roof 14 of the cutting tooth 6. If, for example, a slightly rounded rise 28 is provided in the region of the trailing rivet hole 9 of the connecting link 3, the leading region of the drive link 2 can be covered completely laterally which can be advantageous with respect to the mechanical loading and the guidance of chips by the drive link 2.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw, the saw chain defining a longitudinal axis and being movable in a running direction on said motor-driven chain saw, the saw chain comprising:

a plurality of center drive links and a plurality of side connecting links, the links being pivotally interconnected by rivets lying transversely to said longitudinal axis;

said saw chain defining a center plane passing through said longitudinal axis;

a portion of said connecting links being configured as cutting links;

each one of said cutting links including a rearward wall portion bent over toward said center plane to define a cutting tooth having a roof;

said roof having a leading edge extending transversely to said center plane and defining a cutting edge;

said roof also having a trailing edge extending transversely to said center plane and said trailing edge being at a lower elevation than said leading edge;

individual ones of said drive links each having a body defining two rivet holes formed therein and each one of said individual ones of said drive links having an upper edge;

said upper edge having a region extending approximately between first and second imaginary lines passing through said rivet holes perpendicular to said longitudinal axis;

said upper edge having a recess formed therein in said region between said first and second imaginary lines;

said recess being below or behind said trailing edge of said roof at a distance therefrom in said running direction and said recess delimiting a chip channel for guiding chips cut by said cutting edge;

said rivet holes having center points connected by a third imaginary line;

said recess, when viewed in side elevation, being configured in said region of said upper edge to be asymmetrical relative to an imaginary center perpendicular bisecting said third imaginary line into two equal segments and said recess having a lowest location disposed offset from said imaginary center perpendicular;

said region of said upper edge being conjointly defined by two edge segments;

one of said edge segments being a leading edge segment and the other one of said edge segments being a trailing edge segment relative to said running direction;

one of said rivet holes being a forward rivet hole and the other one of said rivet holes being a rearward rivet hole relative to said running direction;

said leading edge segment extending from approximately above said forward rivet hole and dropping in elevation relative to said third imaginary line to said lowest location; and, said trailing edge segment extending rearwardly from said lowest location with rising elevation relative to said third imaginary line to define a ramp for the chips guided through said chip channel.

2. The saw chain of claim 1, said edge segments conjointly defining an obtuse angle facing toward said roof and said obtuse angle being approximately in the range of approximately 110° to 140°.

3. The saw chain of claim 1, said leading edge and said trailing edge segments conjointly defining a rounded transition therebetween.

4. The saw chain of claim 1, said leading edge and said trailing edge segments conjointly defining an angled transition therebetween.

5. The saw chain of claim 1, said leading edge segment being convex.

6. The saw chain of claim 1, said leading edge segment being concave.

7. The saw chain of claim 1, said leading edge segment being configured as an inclined plane inclined relative to said third imaginary line.

8. The saw chain of claim 7, said inclined plane extending approximately parallel to said roof.

9. The saw chain of claim 7, said roof and a fourth imaginary line conjointly defining a first angle; said fourth imaginary line being parallel to said third imaginary line and passing through said leading edge of said roof; said roof dropping off at said first angle from said leading edge to said trailing edge thereof; and, said inclined plane dropping off at a second angle greater than said first angle at which said roof drops off.

10. The saw chain of claim 1, each one of said individual ones of said drive links having a contour and said trailing edge segment being an extension of said contour.

11. The saw chain of claim 1, said deepest location being rearward of said trailing edge of said roof viewed in the direction of movement of said saw chain.

12. The saw chain of claim 1, said deepest location being approximately in the region of said trailing rivet hole of said drive link.

13. The saw chain of claim 1, said two edge segments each being rounded; and, one of said edge segments having a radius of curvature much greater than the radius of curvature of the other one of said edge segments.

14. The saw chain of claim 13, said leading edge segment having the smaller of said radii of curvature.

15. The saw chain of claim 1, said leading edge segment and said trailing edge segment having respectively different slopes.

16. The saw chain of claim 1, said trailing edge segment having a slope steeper than said leading edge segment.

* * * * *